US006796226B2

(12) United States Patent
Kolbe et al.

(10) Patent No.: US 6,796,226 B2
(45) Date of Patent: Sep. 28, 2004

(54) PRINTING METHOD

(75) Inventors: Wilfried Kolbe, Gülzow (DE); Klaus Schirrich, Bielefeld (DE); Harald Bollhöfener, Bielefeld (DE); Hartmut Grosse, Ratungen (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 16 days.

(21) Appl. No.: 10/090,661

(22) Filed: Mar. 5, 2002

(65) Prior Publication Data

US 2002/0134267 A1 Sep. 26, 2002

(30) Foreign Application Priority Data

Mar. 22, 2001 (DE) ..... 101 14 250

(51) Int. Cl.[7] ..... B41F 5/06; B41F 17/10; B41F 5/16

(52) U.S. Cl. ..... 100/171; 101/173; 101/174; 101/176; 101/178; 101/180; 101/191; 101/484; 101/485; 101/170

(58) Field of Search ..... 101/171, 173, 101/174, 176, 178, 180, 191, 484, 188, 189, 485, 175, 181

(56) References Cited

U.S. PATENT DOCUMENTS 3,921,519 A 11/1975 Zimmer
4,421,027 A * 12/1983 Fischer ..... 101/142
4,479,431 A * 10/1984 Germann ..... 101/136
4,628,816 A * 12/1986 Six ..... 101/483
5,081,926 A * 1/1992 Rodi ..... 101/211
5,152,222 A * 10/1992 Okamura et al. ..... 101/211
5,479,856 A * 1/1996 Wirz ..... 101/177
5,528,986 A * 6/1996 Andersson et al. ..... 101/219
5,701,817 A * 12/1997 Thunker et al. ..... 101/350.1
5,845,576 A * 12/1998 Junghans ..... 101/484
5,907,999 A * 6/1999 Lusar et al. ..... 101/484

FOREIGN PATENT DOCUMENTS

FR 2248158 5/1975
WO WO 88/07448 * 10/1988 ..... B41F/5/06

* cited by examiner

*Primary Examiner*—Andrew H. Hirshfeld
*Assistant Examiner*—Marissa Ferguson
(74) *Attorney, Agent, or Firm*—Richard M. Goldberg

(57) ABSTRACT

A method of printing with a rotary printing press having a plurality of printing cylinders that are adapted to be adjusted on and off from a running web, with a length of a printed image being larger than a peripheral length of the largest one of the printing cylinders, the method including the steps of subdividing the printed image into elements, printing these elements with different printing cylinders, and periodically shifting at least one of the printing cylinders off from the web, each time for at least a duration of one turn of the printing cylinder.

9 Claims, 3 Drawing Sheets

PRINTING METHOD

BACKGROUND OF THE INVENTION

The invention relates to a method of printing on a rotary printing press having a plurality of printing cylinders that are adapted to be adjusted against a web of a printing medium.

In conventional printing presses of this type, the plurality of printing cylinders serve for printing in several colours. For example, flexographic printing presses are known, in which a plurality of ink units which each comprise a printing cylinder are arranged around the periphery of a common back pressure cylinder. The web passes around the back pressure cylinder and is printed successively in the individual ink units with the colour components of the image to be printed. Since the printed image is repeated after each rotation of the printing cylinder, the printing length, i.e. the length of the image to be printed in feed direction of the web, is limited by the peripheral length of the printing cylinder. Thus, for printing images in a large format, a printing press is required in which the printing cylinders have a large diameter so as to admit a large printing length and/or have a large axial length, so as to permit a correspondingly large printing width for the image to be printed in transverse format. In both cases, an expensive printing press is required, which has such a construction that large printing lengths and/or printing widths are permitted.

SUMMARY OF THE INVENTION

It is an object of the invention to provide a method permitting to print images with a large format on a compact and inexpensive printing press.

According to the invention, this object is achieved by the features that the printed image is divided into a plurality of elements which are printed with different printing cylinders, and that at least one of these printing cylinders is periodically lifted off from the web during the printing operation, each time for a duration corresponding to at least one turn of the printing cylinder.

As a consequence, the peripheral length of the printing cylinder does not have to be equal to the total length of the printed image, but is only required to have the length of the element to be printed with this printing cylinder. When one element of the image has been printed during one turn of the printing cylinder, this printing cylinder is lifted off from the web for at least the duration of one turn, so that the corresponding site on the web is left empty. Then, another element of the image is printed on this empty site by means of another printing cylinder. In this operation, the longitudinal register is selected such that the elements printed one after the other with different printing cylinders are in registry and are combined to form the desired printed image. The maximum format of the printed image that can be printed with the printing press in this way is accordingly limited in one direction by the printing width of the machine, but can, in the other direction, amount to a multiple of the peripheral length of the printing cylinder, depending on the number of printing cylinders being used.

Thus, the method permits a very variable use of the printing press. When the desired printing length is not larger than the peripheral length of the largest printing cylinder, each printing cylinder can be used for another colour component, so that multi-colour printing with a number of colours corresponding to the number of printing cylinders is enabled. As an alternative, however, larger image formats can be printed by using at least two printing cylinders for different elements of the same image. If these elements are to be printed in the same colour or have a common colour component, however, the number of available printing colours is limited, accordingly. This, however, is well acceptable for many practical applications.

For instance, one example of industrial applicability is the printing of large-format tablecloths, e.g. disposable paper tablecloths. On a printing press having six ink units for example, it is then possible to print with three colours and with a printing length corresponding to twice the peripheral length of the printing cylinders.

Another practically important example of applicability is the printing of packaging material, in which the printed images for the individual panels, each of which will later form a single package, have common image elements for one part and different image elements for the other part. The different image elements may for example comprise different type-identifiers, a printed packaging date and the like. If, in a conventional printing method, the peripheral length of the printing cylinders corresponds to three times the length of a panel, for example, then not more than three panels with different image elements can be printed in one and the same run. If a printing press with four ink units is used, but only two colours are needed for the printed image, e.g. one colour for the common single-colour image elements and a second colour for a variable imprint, then two ink units of the printing press remain unused. Now, in the method according to the invention, it is possible to utilise also the two idle ink units for printing imprints. Each printing cylinder of these two ink units can then again produce three different imprints, so that a totality of nine different imprints can be printed in a single run in a very efficient way.

The invention further provides a printing press that is suitable for carrying out the method described above. As is known per-se, the printing press has a shift mechanism for shifting the printing cylinders between a position in which they are engaged against the web and a position in which they are lifted off from the web. According to the invention, this printing press has a control unit adapted to shift at least one of the printing cylinders periodically against and off the web during the printing operation.

Preferably, the shift mechanism is designed such that the length of time needed for shifting the printing cylinder between the engaged the non-engaged position is substantially smaller than the rotation period of the printing cylinder. In conventional flexographic printing presses, such shift mechanisms serve for shifting an anilox roller, that is used for inking the printing cylinder, relatively far away from the printing cylinder and for shifting the printing cylinder relatively far away from the back pressure cylinder or central cylinder, thereby to provide sufficient space for handling the cylinders when the cylinders have to be exchanged, for example. In the printing press according to the invention, however, when the printing cylinder is periodically shifted between the engaged and non-engaged position during the printing operation, this printing cylinder only needs to be lifted off from the web to such an extent that ink is no longer transferred onto the web. To this end, a distance of a fraction of a millimeter is sufficient. Even in case of high speed printing presses, the time needed for shifting may therefore be negligible in comparison to the rotation period of the printing cylinder, so that the image elements printed by different printing cylinders may be butted precisely and seamlessly and essentially without overlap.

The shifting mechanism may have a known construction, for example, in the form of ball bearing-type spindle/nut units with servo motors, by which the displacements may be controlled very precisely, so that the original position may be restored with high accuracy. These drive mechanisms act upon brackets in which the printing cylinders are journalled and which are guided for example on linear guides with ball bearings.

For achieving, on the one hand, large displacements in case that a cylinder has to be changed, and, on the other hand, small displacements in the periodic shifting operations, a two-stage drive system may also be used. The long-stroke displacements are then achieved by a first stage, whereas the second stage is provided for the shifting movements having only a very short stroke. In this case, the short-stroke movements may also be limited by stops. The drive mechanisms may as well be formed by hydraulic or pneumatic actuators or piezoelectric actuators, for example.

In general, it will be advantageous if at least two printing cylinders can be shifted periodically. In special applications, for example, when the printed image consists only of two elements, i.e. a relatively short imprint and a background in a uniform colour or with a periodic pattern, it is sufficient that only the printing cylinder for the imprint can be shifted.

BRIEF DESCRIPTION OF THE DRAWINGS

Embodiment examples of the invention will now be described in conjunction with the accompanying drawings, in which.

DESCRIPTION OF PREFERRED EMBODIMENTS

Figure 1:
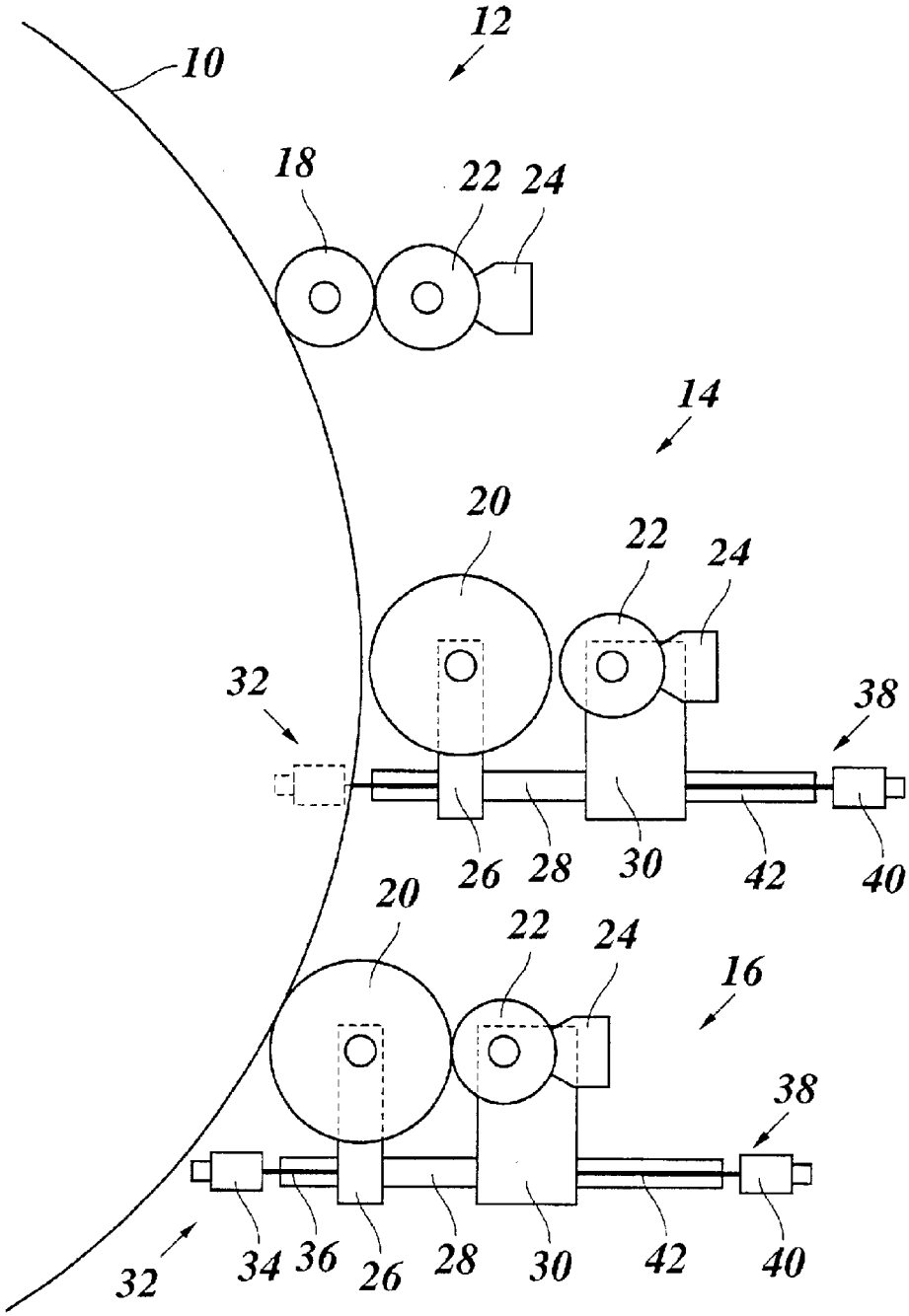
FIG. 1 is a schematic view of a part of a flexographic printing press.

The rotary printing press shown in FIG. 1, a flexographic printing press for example, comprises a large-diameter central cylinder 10 and a plurality of ink units arranged at the periphery thereof. In the drawing, only three ink units 12, 14 and 16 have been shown. Each ink unit comprises a printing cylinder 18, 20 adapted to be adjusted against a web of printing medium which passes over the central cylinder 10 but has not been represented in FIG. 1, an anilox roller 22 for inking the printing cylinder, and a chamber-type doctor blade 24 for inking the anilox roller 22. The printing cylinders 20 are rotatably supported on brackets 26, and the brackets are slidable on guides 28, as has only been shown for the ink units 14 and 16 in FIG. 1. The ends of the anilox roller 22 and the doctor blade 24 corresponding to one another are supported on a common bracket 30 which is slidable on the same guide 28 or on a separate guide. A shift mechanism 32 which, in the example shown, is formed by a servo motor 34 and a spindle drive 36, is associated with each of the brackets 26 for the printing cylinders. A separate shift mechanism 38 which is also formed by a servo motor 40 and a spindle drive 42 is associated with each of the brackets 30. The servo mortors 34 and 40 have an integrated displacement sensor permitting to measure and control the shift displacements with high accuracy. Thus, the printing cylinders 20 may be adjusted precisely into a printing position in which they are engaged against the central cylinder 10 and hence in contact with a web to be printed. Likewise, the anilox rollers 22 may be adjusted against the printing cylinders 20 and may be lifted off therefrom.

In FIG. 1, the printing cylinder 20 of the ink unit 14 is shifted away from the central cylinder 10, so that no ink is transferred onto the web, whereas the printing cylinder 20 of the ink unit 16 is adjusted against the central cylinder 10. Correspondingly, the anilox roller 22 is shifted away from the printing cylinder 20 in the ink unit 14, whereas it is adjusted against the printing cylinder 20 in the ink unit 16. In case of the ink unit 14, i.e. the ink unit which is not operating at this instant, the anilox roller might optionally remain in engagement with the printing cylinder 20 or could be shifted against and off the printing cylinder 20 at timings with an appropriate offset for supplying the ink in accordance with the demand.

Figure 2:
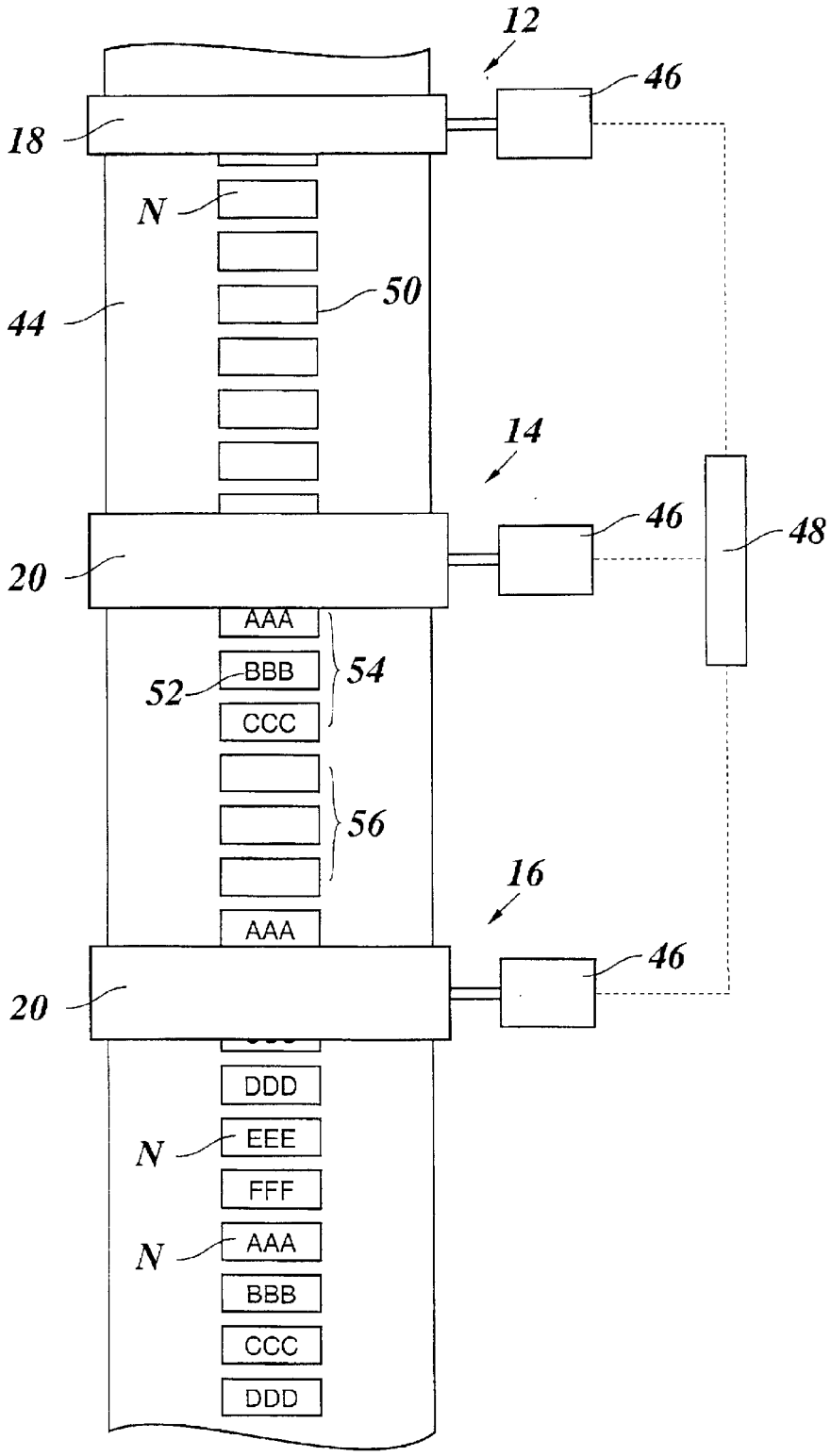
FIG. 2 is a schematic development of a web of printing material with associated printing cylinders.

FIG. 2 illustrates a printing method which may be carried out with the printing press illustrated in FIG. 1. Here, the web 44 has been shown schematically in a development. What has been shown of the ink units 12, 14 and 16 are only the printing cylinders 18, 20 and drive motors 46 which are each mounted directly on an axle of the associated printing cylinder 18 and 20, respectively. By means of a control unit 48, the drive motors 46 are synchronised electronically with one another and with the central cylinder 10 which has not been shown in FIG. 2. The control unit 48 also acts upon the servo motors 34, 40 of the shift mechanisms 32, 38 and thus controls the shift operations of the printing cylinders 20. These shift operations may, without any problems, be performed while the printing press is running, because the associated drive motors 46 move together with their respective printing cylinders.

As an example, it shall now be assumed that the web 44 serves for producing packaging material. Each panel N of the packaging material shall be provided with a printed image which, in the example shown, consists of two elements, namely a frame 50 which is equal for all panels and a text imprint 52 which varies from panel to panel. With the method described here, six different panels which differ from one another in their text imprint 52 are printed in one operation, i.e. in a single print run. The text imprints are symbolised in FIG. 2 by character sequences "AAA", "BBB", . . . , "FFF".

The printing cylinder 18 of the ink unit 12 is used for printing the equal frames 50 for all panels. The peripheral length of the printing cylinder 18 corresponds to the length of one panel. The ink unit 14 is used for printing the text imprints 52 (AAA, BBB, CCC) for three different panels. To this end, the peripheral length of the printing cylinder 20 must be three times the peripheral length of the printing cylinder 18, and, consequently, its diameter must also be three times as large (the drawing is not on scale). It may be assumed that the printing cylinders 20 have the largest diameter that can be installed in the printing press. It would therefore not be possible to print all six different text imprints 52 with only a single printing cylinder. For this reason, in the method described here, the printing cylinder 20 of the ink unit 14, once it has printed the text imprints 52 for three successive panels, is lifted off from the web 44 for the duration of one cylinder turn, so that the panels exiting from the ink unit 14 form alternating groups 54, 56 of three panels each. The panels of the group 54 have a text imprint 52, whereas the panels of the group 56 consist only of the empty frame 50.

Then, the ink unit 16 is used for printing three other text imprints (DDD, EEE, FFF) for the panels of the group 56. To this end, the printing cylinder 20 of the ink unit 16 is shifted on and off with timings opposite to those of the ink unit 14.

Finally, the resulting printed image thus consists of a sequence of panels with six different text imprints 52 and has a printing length which is twice the peripheral length of the printing cylinders 20.

If another ink unit is available, the method may readily be generalised to cases in which the effective printing length is three times the peripheral length of the printing cylinders. The printed image could then for example consist of a sequence of nine panels with different text imprints 52. The printing cylinders 20 would then alternatingly be shifted on (against the web) for one turn and off (away from the web) for two turns, with appropriate time offsets.

Figure 3:
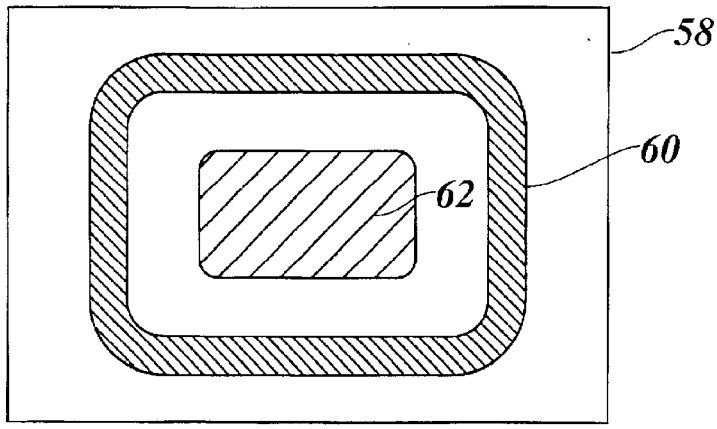
FIG. 3 is a large-format printed image.

As another example, FIG. 3 shows a tablecloth 58 that is to be provided with a two-colour printed image which covers essentially the total area of the cloth. Here, the printed image consists of an outer frame 60 extending in the vicinity of the peripheral edge of the tablecloth, and an internal area 62 which has a different colour and the length of which is not more than half the length of the tablecloth. The tablecloth 58 shall have the dimensions 1900×1300 mm. It shall be assumed that a printing machine available for printing permits a maximum printing width of hardly more than 1300 mm and a maximum peripheral length of the printing cylinders of hardly more than 1000 mm. Then, three printing cylinders having a peripheral length of 950 mm, corresponding to exactly one half of the length of the tablecloth, are used for printing.

Figure 4:
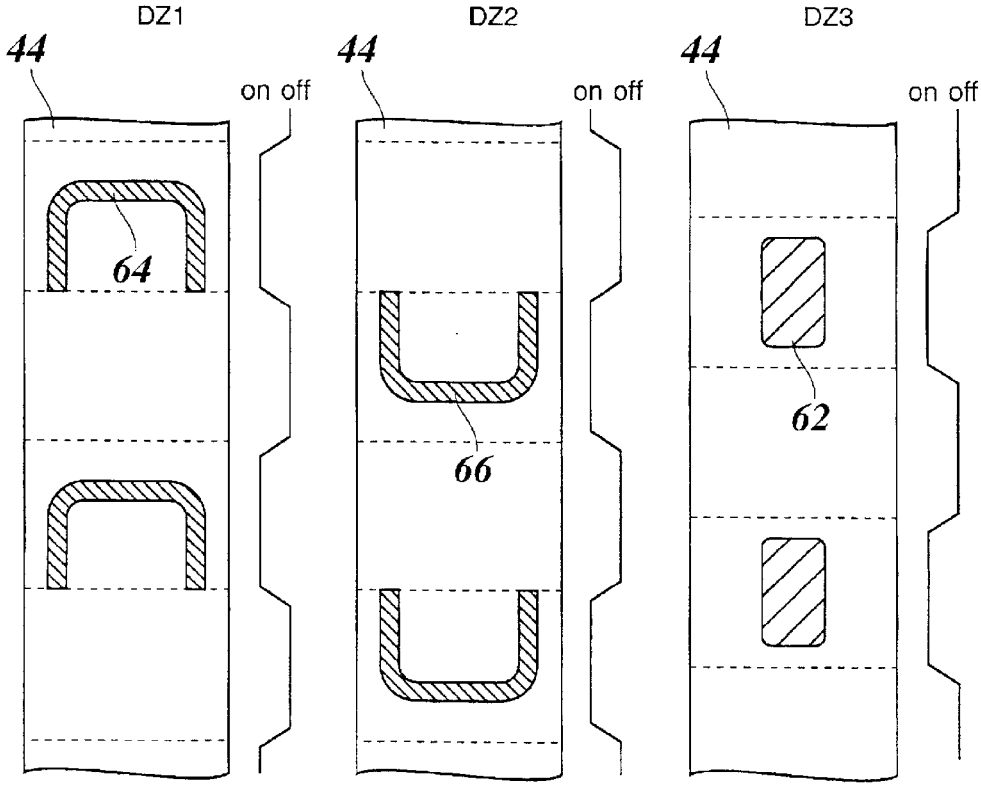
FIG. 4 is a diagram illustrating a method for generating the printed image shown in FIG. 3.

FIG. 4 illustrates how the complete printed image on the tablecloth 58 can be generated. The frame 60 is subdivided into two elements 64, 66 which are mirror-images of one another and are printed with printing cylinders DZ1 and DZ2 of two ink units of the same colour. A third element is formed by the internal area 62 which must be printed in a different colour. Since, however, the length of the internal area 62 is smaller than the peripheral length of the printing cylinder, a third printing cylinder DZ3 is sufficient for this. The on and off phases during the printing operation are indicated for each of the three printing cylinders in relation to the position of the elements 62, 64, 66 on the web 44. Dashed horizontal lines subdivide the web into sections the length of which corresponds to the peripheral length of the printing cylinders.

The printing cylinders DZ1 and DZ2 operate with strokes essentially opposite to one another, so that the elements 64, 66 are combined to form the frame 60. In contrast, the on and off periods of the printing cylinder DZ3 are time-shifted by one half period in comparison to the strokes of the other printing cylinders, so that the internal area 62 is printed in the centre of the frame 60.

This embodiment example may also be extended to the applications with even larger printing lengths and an even larger number of elements in an analogous way.

What is claimed is:

1. A method of printing with a rotary printing press having a plurality of printing cylinders that are adapted to be adjusted on and off from a running web, the method comprising the steps of:

providing a printed image having a length which is larger than a peripheral length of a largest one of a plurality of printing cylinders of a rotary printing press, subdividing the printed image into elements such that each element has a length which is not larger than the peripheral length of the largest one of the printing cylinders, the printed image comprising a number of subsequent panels, said panels having at least one element that is different from panel to panel, and wherein these elements are printed with a plurality of printing cylinders, printing these elements with different printing cylinders, said step of printing including the step of printing at least one of said elements with each printing cylinder, and periodically shifting one of said printing cylinders off from the web, each time for at least a duration of one turn of the printing cylinder, said step of periodically shifting includes the step of timing "on" and "off" adjustment movements of the printing cylinders such that each printing cylinder leaves those panels empty for which the elements are printed with another one of the printing cylinders, and wherein the printed image has an element that is identically repeated for each panel, and said step of printing includes the step of printing this element with a separate printing cylinder which remains constantly in an "on" position.

2. A method of printing with a rotary printing press having a plurality of printing cylinders that are adapted to be adjusted on and off from a running web, the method comprising the steps of:

providing a printed image having a length which is larger printing cylinders of a rotary printing press, subdividing the printed image into elements such that each element has a length which is not larger than the peripheral length of the largest one of the printing cylinders, printing these elements with different printing cylinders, wherein the step of printing includes the step of printing elements having a length of less than a peripheral length of the printing cylinder, as measured in a feed direction of the web, with a single printing cylinder, periodically shifting one of said printing cylinders off from the web, each time for at least a duration of one turn of the printing cylinder, and timing "on" adjustments of said single printing cylinder such that the element printed thereby is inserted into the printed image in a predetermined position and such that the element printed by the single printing cylinder overlaps at least two of the elements printed with different printing cylinders.

3. The method of claim 2:

further comprising the steps of:

timing "on" adjustments of this single printing cylinder such that the element printed thereby is inserted into the printed image in a predetermined position, and adjusting a plurality of printing cylinders "on" and "off" at timings that are offset in such a manner that an "on" adjustment of one printing cylinder occurs at a same longitudinal register as an "off" adjustment of another printing cylinder, so that the elements printed by these printing cylinders are in registry and form, in combination, an integral pattern.

4. A rotary printing press comprising:

a plurality of printing cylinders of a rotary printing press, the printing cylinders supported individually for sliding movement, the printing cylinders having a peripheral length such that a largest one of the printing cylinders has a peripheral length which is smaller than a printed image to be printed, a feeding device for feeding a web to be printed, a shift mechanism for adjusting the printing cylinders individually on and off from said web such that the shift mechanism exerts large displacements during an operation of a cylinder exchange and smaller displacements during periodic shifting operations, the shift mechanism including:

a servomotor, and a displacement sensor, and a control unit adapted to control the shift mechanism for at least one of said plurality of cylinders such that this cylinder is periodically adjusted on an off from the web during the printing operation.

5. The printing press of claim 4, wherein said shift mechanism is adapted to shift said at least one printing cylinder, that is adjusted on and off periodically, between an "on" position and an "off" position within a length of time that is substantially smaller than a rotation period of said printing cylinder.

6. The printing press of claim 4, wherein a distance between said "on" position and said "off" position of said at least one printing cylinder is less than 1 mm.

7. The printing press of claim 5, wherein a distance between said "on" position and said "off" position of said at least one printing cylinder is less than 1 mm.

8. The printing press of claim 4, wherein said at least one printing cylinder that is periodically adjustable, has axle and a drive motor arranged on said axle.

9. The printing press of claim 7, wherein said at least one printing cylinder that is periodically adjustable, has axle and a drive motor arranged on said axle.

* * * * *